United States Patent [19]

Boyd

[11] 3,970,145

[45] July 20, 1976

[54] STANDING VALVE ASSEMBLY

[75] Inventor: Gerald K. Boyd, Kingfisher, Okla.

[73] Assignee: Production Service & Equipment Incorporated, Kingfisher, Okla.

[22] Filed: Sept. 29, 1975

[21] Appl. No.: 617,867

[52] U.S. Cl. ..... 166/188

[51] Int. Cl.[2] ..... E21B 33/12

[58] Field of Search ..... 166/133, 188, 224 R

[56] References Cited

UNITED STATES PATENTS

| | | | |
|---|---|---|---|
| 2,447,827 | 8/1948 | Turechek | 166/133 |
| 2,562,458 | 7/1951 | Hartsell | 166/188 |
| 2,669,305 | 2/1954 | Condra | 166/133 |
| 3,180,420 | 4/1965 | Manson, Jr. et al. | 166/133 |

*Primary Examiner*—James A. Leppink
*Attorney, Agent, or Firm*—Dunlap, Codding & McCarthy

[57] ABSTRACT

A standing valve for use in a tubing string, the standing valve having a bored mandrel, a packing element with the lower end thereof sealingly connected around the mandrel, a bored valve body slidably retained on the upper end of the mandrel so as to be slidable in one direction to wedge the upper end of the packing element into sealing arrangement with the tubing string, and a valve slidably retained in the valve body to open and close the bore therethrough.

7 Claims, 1 Drawing Figure

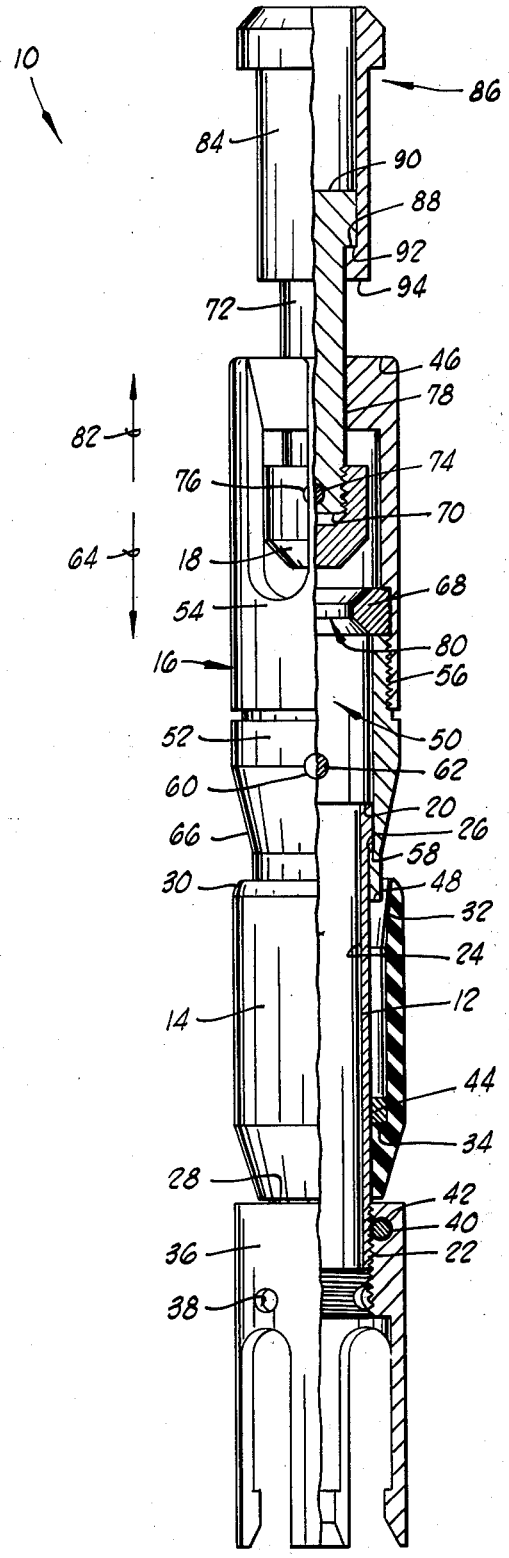
10
86
84
90
88
92
94
72
46
78
82
74
76
70
64
18
68
54
80
16
56
52
50
62
60
20
26
66
58
30
48
32
24
12
14
44
34
28
42
40
36
22
38

STANDING VALVE ASSEMBLY

BACKGROUND OF THE INVENTION

1. Field of the Invention

This invention relates generally to standing valves and, more particularly, but not by way of limitation, to standing valves which facilitate the equalization of pressures above and below the standing valve.

2. Description of the Prior Art

Prior art standing valves have in general been excessively long, thereby precluding the use thereof in rough or kinky grades of tubing. Further, the packing elements employed in the prior art standing valves usually provide less than a satisfactory seal when used in a badly pitted or scored tubing string, thereby requiring the use of a plurality of such packing elements on each standing valve. In addition, prior art equalizing standing valves have in general had the fishing neck formed as an integral part of the valve stem, thereby subjecting the valve and valve seat to excessive stresses when the standing valve is set by jarring down on the fishing neck.

SUMMARY OF THE INVENTION

It is an object of this invention to provide a standing valve having improved sealing efficiency.

A further object of this invention is to provide a standing valve of shorter length for efficient use in rough grade tubing strings.

Another object of this invention is to provide a standing valve having a fishing neck which floats on the valve stem, thereby allowing the jar down forces to be transferred to the valve body substantially independently of the valve and valve seat.

Still another object of this invention is to provide a standing valve having a packing element which is commercially available and easily replaceable.

Yet another object of this invention is to provide a standing valve which is simple and rugged in construction and which is economically manufactured.

Other objects and advantages of this invention will be evident from the following detailed description when read in conjunction with the accompanying drawing which illustrates the preferred embodiment of the invention.

BRIEF DESCRIPTION OF THE DRAWING

The single FIGURE is a partial sectional, elevational view of the standing valve of the present invention.

DESCRIPTION OF THE PREFERRED EMBODIMENT

Shown in the drawing and designated by the general reference number 10 is a standing valve constructed in accordance with the present invention. The standing valve 10 is comprised primarily of a mandrel 12, a packing element 14, a valve body 16 and a valve 18.

The mandrel 12 has an upper end 20, a lower end 22, and a bore 24 therethrough communicating between the upper end 20 and the lower end 22 thereof. In the preferred embodiment, the mandrel 20 has a downwardly facing, annular shoulder 26 extending radially outward near the upper end 20 thereof and the lower end 22 is threaded for reasons which will be made more apparent below.

The packing element 14 is of substantially cylindrical shape and in the preferred embodiment is formed from a suitable elastomeric material. The packing element 14 has a lower end 28 sealingly connected around the mandrel 12 between the upper and lower ends 20 and 22, respectively, thereof. The packing element 14 has an upper end 30 circumferentially disposed between, and generally spaced from, the mandrel 12 and an adjacent portion of a tubing string (not shown). The packing element 14 has an inwardly tapered portion 32 near the upper end 30 thereof and an upwardly facing annular shoulder 34 extending radially inward near the lower end 28 thereof. A commerically available product suitable for use as the packing element 14 is the G. W. Guiberson Swab Cub available from G. W. Guiberson Company of Dallas, Texas.

In the preferred embodiment, a fishing neck latch 36 of conventional design is connected to the lower end 22 of the mandrel 12 by being threaded thereon. The fishing neck latch 36 is preferrably provided with a plurality of holes 38 providing fluid communication between the exterior of the fishing neck latch 36 and the bore 24 through the mandrel 12 when the fishing neck latch 36 is set on the fishing neck of a conventional tubing stop (not shown). The fishing neck latch 36 is also preferrably provided with a transverse bore 40 having a retaining pin 42 therein, the bore 40 describing a cord therethrough which intersects at least a portion of the threads on the lower end 22 of the mandrel 12 for purposes which will be made more apparent below.

A retaining ring 44 is circumferentially disposed around, and frictionally engaged with, the mandrel 12 and is positioned to abut the shoulder 34 of the packing element 14. The retaining ring 44 cooperates with the fishing neck latch 36 to substantially restrict the movement of the packing element 14 relative to the mandrel 12.

The valve body 16 has an upper end 46, a lower end 48 and a bore 50 therein. The valve body 16 is preferrably formed from a lower portion 52 and an upper portion 54 which are interconnected by suitable means such as the threads shown at 56. In the preferred embodiment, the upper portion 54 forms a valve cage for retaining the valve 18 therein while providing fluid communication between the exterior of the upper portion 54 of the valve body 16 and the bore 50 through the valve body 16 in a conventional manner.

The valve body 16 is slidably retained on the mandrel 12 between the packing element 14 and the upper end 20 of the mandrel 12 such that the bore 50 is in fluid communication with the bore 24 through the mandrel 12. More particularly, the valve body 16 has an upwardly facing annular shoulder 58 extending radially inward near the lower end 48 thereof which is sized to engage the shoulder 26 near the upper end 20 of the mandrel 12 when the upper end 20 of the mandrel 12 is disposed in the bore 50 through the valve body 16. In the preferred embodiment, the lower portion 52 of the valve body 16 is provided with a transverse bore 60 sized to receive a shear pin 62 and positioned so as to restrict the sliding movement of the valve body 16 on the mandrel 12 in a first direction 64 when the shear pin 62 is present.

The valve body 16 has a tapered portion 66 near the lower end 48 thereof such that the outer diameter of the lower end 48 of the valve body 16 is less than the inner diameter of the upper end 30 of the packing element 14. Thus it is clear that, in the absence of the shear pin 62, the valve body 16 is slidable in a first direction 64 to move the lower end 48 thereof into the packing element 14 between the upper end 30 of the packing element 14 and the mandrel 12 to wedge the upper end 30 of the packing element 14 into sealing engagement with an adjacent portion of a tubing string (not shown) via the interaction of the tapered portions 32 and 66.

The valve 18 is slidably retained in the bore 50 through the valve body 16, and, more particularly, in the upper portion 54 of the valve body 16. In the preferred embodiment, the valve body 16 has a valve seat 68 formed from a suitable corrosion resistant material such as stainless steel, retained in the bore 50 therethrough in cooperative relationship with the valve 18. More particularly, the valve seat 68 is retained inside the valve body 16 at the interior interface between the upper and lower portions 52 and 54, respectively, thereof.

The valve 18 is threaded on the lower end 70 of a stem 72 having an outer diameter smaller than the outer diameter of the valve 18. The valve 18 is retained in threaded engagement with the stem 72 by a pin 74 disposed in a bore 76 passing transversely through the valve 18 and the lower end 70 of the stem 72. The stem 72 is slidably disposed through a bore 78 through the upper end of the valve body 16. Thus, it is clear that the valve 18 on the stem 72 is slidable in the first direction 64 to close the bore 50 through the valve body 16 by closing the bore 80 through the valve seat 68. Further, it is clear that the valve 18 is slidable in a second direction 82 substantially opposite to the first direction 64 to open the bore 50 through the valve body 16 by opening the bore 80 through the valve seat 68.

In the preferred embodiment, a head 84 having a fishing neck 86 formed thereon, is slidably connected to the valve 18 by being retained on the stem 72 via the interaction of a downwardly facing annular shoulder 88 extending radially outward from the upper end 90 of the valve stem 72 and a corresponding upwardly facing annular shoulder 92 extending radially inward from the lower end 94 of the head 84. The head 84 is slidable in the first direction 64 into engagement with the upper end 46 of the valve body 16 substantially independently from the valve 18 and the stem 72. Further, the head 84 is slidable in the second direction 82 into engagement with the stem 72 via the shoulders 88 and 92.

Assembly of the Preferred Embodiment

Assuming that the various elements described above as comprising the standing valve 10 are in a dissassembled relationship, the mandrel 12 should be inserted through the bore 50 in the lower portion 54 of the valve body 16 until the shoulders 26 and 58 are abutting. The shear pin 62 may then be inserted through the bore 60 in the valve body 16 thereby restricting further movement of the valve body 16 relative to the mandrel 12. The retaining ring 44 should then be positioned on the mandrel 12 in a desired position. The packing element 14 may then be positioned over the lower end 22 of the mandrel 12 so that the shoulder 34 abuts the retaining ring 44. The fishing neck latch 36, if used, may then be threaded onto the lower end 22 of the mandrel 12 thereby restricting the movement of the packing element 14 between the retaining ring 44 and the fishing neck latch 36. The bore 40 should then be drilled through the fishing neck latch 36 such that the bore 40 intersects substantially tangentially the threaded portion on the lower end 22 of the mandrel 12. The pin 42 may then be inserted into the bore 40 thereby substantially preventing the inadvertant rotation of the fishing neck latch 36 relative to the mandrel 12 during handling and operation.

While the above assembly operations are being performed, the valve 18 may be threaded onto the lower end 70 of the stem 72 to a desired position and the bore 76 drilled therethrough. The stem 72 should then be separated from the valve 18 and have the head 84 positioned thereon. The valve 18 can then be inserted into the upper portion 54 of the valve body 16, and the stem 72 inserted through the bore 78 in the upper end 46 of the valve body 16 and threaded into the valve 18 until the bore 76 is realigned. The pin 74 may then be inserted into the bore 76 to prevent the inadvertant disconnection of the valve 18 from the stem 72 during handling and operation. The valve seat 68 may then be positioned in the upper portion 54 of the valve body 16. The upper portion 54 of the valve body 16 may then be threaded into tight engagement with the lower portion 52 of the valve body 16 thereby completing the assembly of the standing valve 10.

Operation of the Preferred Embodiment

In a normal plunger lift operation, the standing valve 10 will be used in conjunction with a conventional tubing stop set at a desired location in a tubing string. The standing valve 10 would normally be lowered in the first direction 64 using conventional Wireline setting tools until the fishing neck latch 36 contacts the fishing neck on the upper end of the tubing stop. Further movement of the Wireline setting tools in the first direction 64 moves the head 84 in the first direction 64 into engagement with the upper end 46 of the valve body 16. Initial jarring down on the head 84 using the Wireline setting tools will cause the fishing neck latch 36 to latch onto the fishing neck on the tubing stop with the jar down force being transferred directly from the head 84 to the valve body 16 with substantially no force being transferred from the valve 18 to the valve seat 68. Further jarring down of the valve body 18 via the head 84 shears the shear pin 62 thereby allowing the valve body 16 to slide in the first direction 64 relative to the mandrel 12. Subsequent jarring down of the valve body 16 in this manner moves the lower end 48 thereof into the packing element 14 thereby wedging the upper end 30 of the packing element 14 into sealing engagement with the tubing string.

With the standing valve 10 set and sealed in the tubing string, the Wireline setting tools may be used to latch a conventional bumper spring to the fishing neck 86 formed on the head 84. The standing valve 10 is then ready for use in a conventional plunger lift operation.

In the event that an excessive amount of fluid accumulates in the tubing string above the standing valve 10 thereby causing the plunger lift operation to fail by reason of overload, a Wireline retrieval tool may be used to slide the head 84 in the second direction 82 via the intervening bumper spring unit until the shoulder 92 on the lower end 94 of the head 84 engages the corresponding shoulder 88 on the upper end 90 of the stem 72. Further movement of the head 84 moves the stem 72 and valve 18 in the second direction 82 to open the bore 80 through the valve seat 68 thereby allowing the fluid load to equalize. With the overload thus relieved, the Wireline retrieval unit may be withdrawn and plunger lift operation recommenced if the well is built up with maximum pressure.

If it becomes necessary for any reason to remove the standing valve 10 from the tubing string, a Wireline retrieval tool need only be lowered into the tubing string and engaged with the fishing neck 86 on the head 84 or a similar fishing neck on an intervening bumper spring. Lifting up on the head 84 via the Wireline retrieval tool slides the head 84 in the second direction 82 until the shoulders 88 and 92 abut each other. Further movement of the head 84 in the second direction 82 moves the valve 18 into engagement with the upper end 46 of the valve body 16. Subsequent upward movement of the head 84 causes the valve body 16 to be slid in the second direction 82 on the mandrel 12 until the shoulders 26 and 58 abut each other thereby substantially withdrawing the lower end 48 of the valve body 16 from engagement with the upper end 30 of the packing element 14. Such disengagement of the valve body 16 from the packing element 14 allows the upper end 30 of the packing element 14 to withdraw from sealing engagement with the tubing string, thereby rendering the standing valve 10 readily movable in the tubing string. Further upward movement of the head 84 via the Wireline retrieval tool is transferred to the fishing neck on the tubing stop via the stem 72, the valve 18, the valve body 16, the mandrel 12, and the fishing neck latch 36 thereby facilitating the disengagement of the tubing stop from the tubing string with subsequent removal of the standing valve 10 and associated down hole equipment.

Changes can be made in the construction and the arrangement of the parts or the elements of the embodiment as disclosed herein without departing from the spirit and scope of the present invention as defined in the following claims.

What is claimed is:

1. A standing valve for use in a tubing string, comprising:

a mandrel having an upper end, a lower end, and a bore therethrough communicating between the upper and lower ends thereof;

a packing element having a lower end sealingly connected around the mandrel between the upper and lower ends thereof, and an upper end circumferentially disposed between, and spaced from, the mandrel and the tubing string;

a valve body slidably retained on the mandrel between the packing element and the upper end of the mandrel, the valve body having an upper end, a lower end and a bore therein in fluid communication with the bore through the mandrel, and being slidable in a first direction to move the lower end thereof into the packing element between the upper end of the packing element and the mandrel to wedge the upper end of the packing element into sealing engagement with the tubing string; and, a valve slidably retained in the bore through the valve body, the valve being slidable in the first direction to close the bore through the valve body, and in a second direction substantially opposite to the first direction to open the bore through the valve body.

2. The standing valve of claim 1 further defined to include:

a head slidably connected to the valve, the head being slidable in the first direction into engagement with the valve body substantially independently from the valve, and in the second direction into engagement with the valve.

3. The standing valve of claim 2 wherein the head is further characterized as having a fishing neck formed thereon.

4. The standing valve of claim 1 wherein the mandrel is further characterized as having a fishing neck latch connected to the lower end thereof.

5. The standing valve of claim 1 further defined to include a shear pin disposed transversely through the valve body substantially preventing sliding movement of the valve body relative to the mandrel in the first direction.

6. The standing valve of claim 1 wherein the valve body is further characterized as having a valve cage formed on the upper end thereof.

7. The standing valve of claim 1 further defined to include a valve seat retained in the bore through the valve body in cooperative relationship with the valve.

* * * * *